United States Patent [19]

Sherman

[11] Patent Number: 4,483,168

[45] Date of Patent: Nov. 20, 1984

[54] FORMING APPARATUS

[76] Inventor: Alden O. Sherman, 85 Weston Rd., Weston, Conn. 06883

[21] Appl. No.: 413,412

[22] Filed: Aug. 31, 1982

[51] Int. Cl.[3] ..... B21H 7/16; B21B 29/00

[52] U.S. Cl. ..... 72/220; 72/241

[58] Field of Search ..... 72/220, 192, 207, 214, 72/241

[56] References Cited

U.S. PATENT DOCUMENTS

| | | | |
|---|---|---|---|
| 557,922 | 4/1896 | Webster | 72/220 |
| 1,429,352 | 9/1922 | Janke | 72/214 X |
| 3,166,008 | 1/1965 | Lewandoski | 72/214 X |
| 3,550,418 | 12/1970 | McLeod | 72/192 |
| 3,808,863 | 5/1974 | Marcovitch | 72/241 X |

FOREIGN PATENT DOCUMENTS

| | | | |
|---|---|---|---|
| 580919 | 11/1977 | U.S.S.R. | 72/214 |

*Primary Examiner*—Francis S. Husar
*Assistant Examiner*—Steven B. Katz
*Attorney, Agent, or Firm*—William G. Rhines

[57] ABSTRACT

This invention relates to apparatus for forming shaped pieces. One embodiment useful in forming metal parts, such as fins for use in the compressor section of gas turbines, comprises apparatus for use with a flat-surfaced die having a forming die depression in the upper surface, which has a pair of cylindrical rolls oriented with their axes parallel and positioned one above the other between the flat surface of the die and the lower surface of a downward acting hydraulic press, with the rolls simultaneously moveable horizontally and in rolling contact with each other, the upper surface of the die, and the lower surface of the hydraulic press platen, by a horizontally oriented hydraulic ram. The platen and the die are limited as to how close they may come to each other, and the rolls are free to "float" away from the die and toward the platen as the lower roll comes into contact with the work piece. Stock may be positioned atop the die and rolled in successive reduction passes into the desired shape and dimensions as determined by the depression in the die.

22 Claims, 18 Drawing Figures

10
12
14
16
15
17
18
20
21
22
26
27
28
30
32
34
35
36
38
39
40
42
44
46
100
102
200
3

40
46
46
43
42
8
44
9
24
33
28
26
25
35
16
32
27
6
6
14
4
4
22
21
20
10a

Fig. 3.
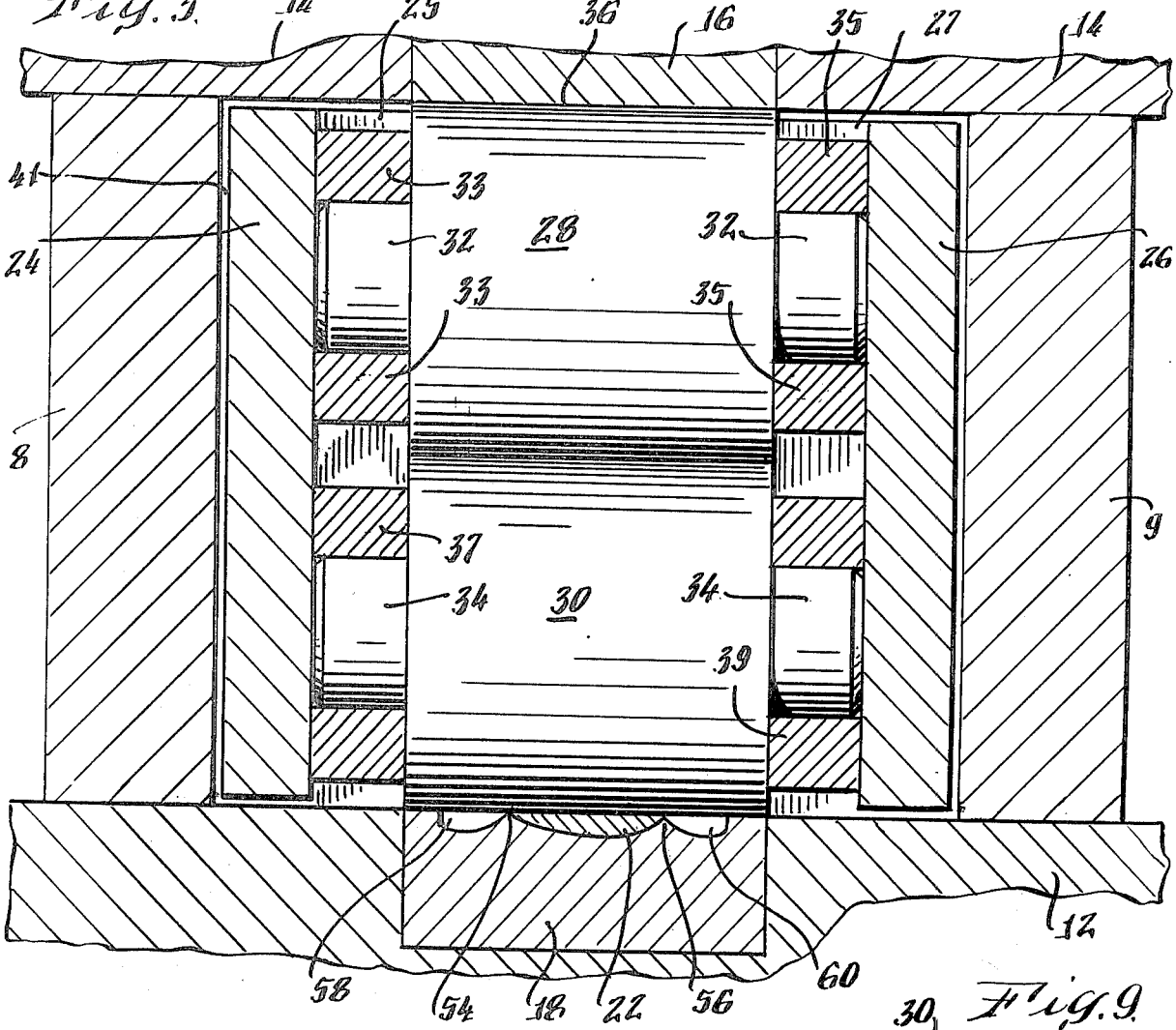
Fig. 9.
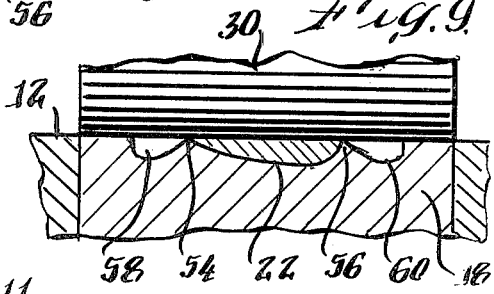
Fig. 8.
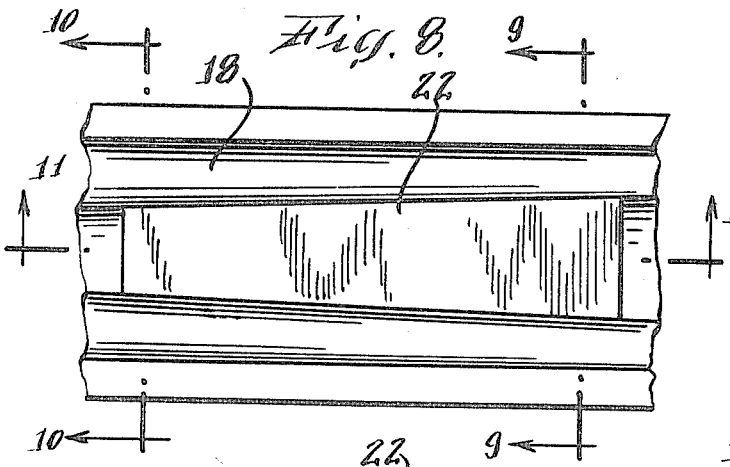
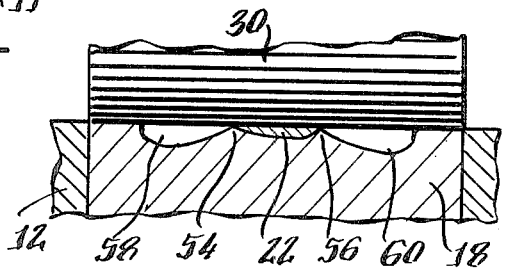
Fig. 11.
Fig. 10
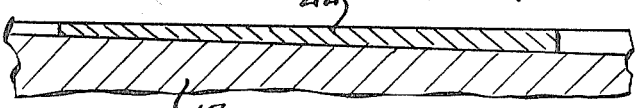
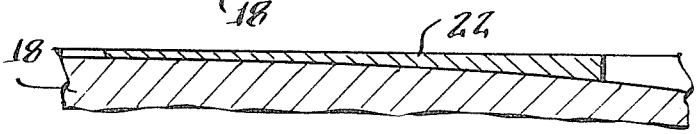
Fig. 12.

FORMING APPARATUS

BACKGROUND

In the field of metal-working, frequently it is desired to produce pieces which are precise in dimensions and tolerances, and are complex in configuration. Further, the nature and environment of utilization may be such as to require the use of materials which, on the basis of materials selection, have physical properties mandated by the intended use which do not afford the most desirable or easiest working properties. Thus, for example, the blades which are used in the compressor section of gas turbine engines, such as those used on jet aircraft, are relatively complex in shape and made from metal, (e.g., Hastalloy or 321 stainless steel), which is very hard and metallurgically stable to accomodate itself to the environment of the engine compressor section which is chemically active and subject to temperatures which range widely. Typical shapes for such blades in their finished form include those which are like are air-foil in cross-section (i.e., like a segment of an ellipse) at one surface, with an arcuate opposing surface, with thin edges, and tapered toward one end with the front and rear blade edges which describe the taper being straight or curved. The traditional manner for making such parts is by machining them out of metal stock; a process which is time consuming, tedious, exacting, and costly, and requires the use of expensive machinery and equipment and highcost labor.

It is known that a continuum of comparatively soft, malleable, ductile metal, such as copper wire, may be formed into a continuous strip of irregular cross-section from which such things as commutation segments, may be punched using paired, parallel-axial rolls which reciprocate while positioned between a forming die and a backing plate. In this connection, reference is made to Janke U.S. Pat. No. 1,429,352. Such devices, however, are inadequate to form complex shapes (i.e., those which are irregular in more than one dimension), as discrete pieces (as contrasted with mere work stock from which pieces may be punched from stock which is not highly ductile or malleable).

Accordingly, it is an object of this invention to provide means for forming articles.

Another object of this invention is to provide such means for the formation of such articles as discrete entities.

Still another object is to provide means for satisfying the foregoing objectives while producing objects which are complex and/or irregular in configuration.

Another object of this invention is to provide means for satisfying the foregoing objectives utilizing work stock which is not highly ductile or malleable.

DESCRIPTION OF INVENTION

Desired objectives may be achieved through practice of the present invention, embodiments of which include apparatus having a base for accomodating a forming die having a planar upper surface with an open-topped forming surface therein, comprising parallel, contacting cylindrical rolls, the axes and line of contact of which are parallel and normal to said upper surface, a downward oriented hydraulic ram having a platen, the bottom surface of which is planar and oriented parallel to said upper surface of said die, spacer means for retaining the platen of such ram when said ram is actuated at a desired distance from said die not less than the aggregate diameters of said rolls, and horizontal hydraulic ram means for causing said rolls to move simultaneously along paths parallel to said upper surface of said die and said lower surface of said platen. Thereby, with forming stock retentively positioned above said forming surface, said rolls may be moved laterally by said horizontal ram means with the bottom roll in contact with said forming stock and the top roll in contact with said platen and with said two rolls in contact with each other, to form the desired shape therefrom by pressing the forming stock into the forming surface as the rolls are backed by the platen against upward deflection to the extent of the downward pressure thereagainst imparted by said vertical hydraulic ram. By sequentially increasing the pressure of the vertical hydraulic ram and mounting the rolls so that they are free to "float" vertically, it is possible to form hard materials into desired objects by making horizontal successive passes of the roll assembly until the final desired configuration is attained.

DESCRIPTION OF DRAWINGS

This invention may be understood from the description of preferred embodiments which follows and from the accompanying drawings in which FIG. 3 is a cross-sectional end view of the embodiment of this invention shown in FIGS. 1 and 2, FIG. 8 is a plan view of a die useful in carrying out this invention, FIG. 9 is a cross-section through line 9—9 of the die shown in FIG. 8, FIG. 10 is a cross-section through line 10—10 of the die shown in FIG. 8, FIG. 11 is a side view cross-section of a die useful in carrying out the invention, FIG. 12 is a side view cross-section of another die useful in carrying out this invention.

DESCRIPTION OF PREFERRED EMBODIMENTS

Figure 1:
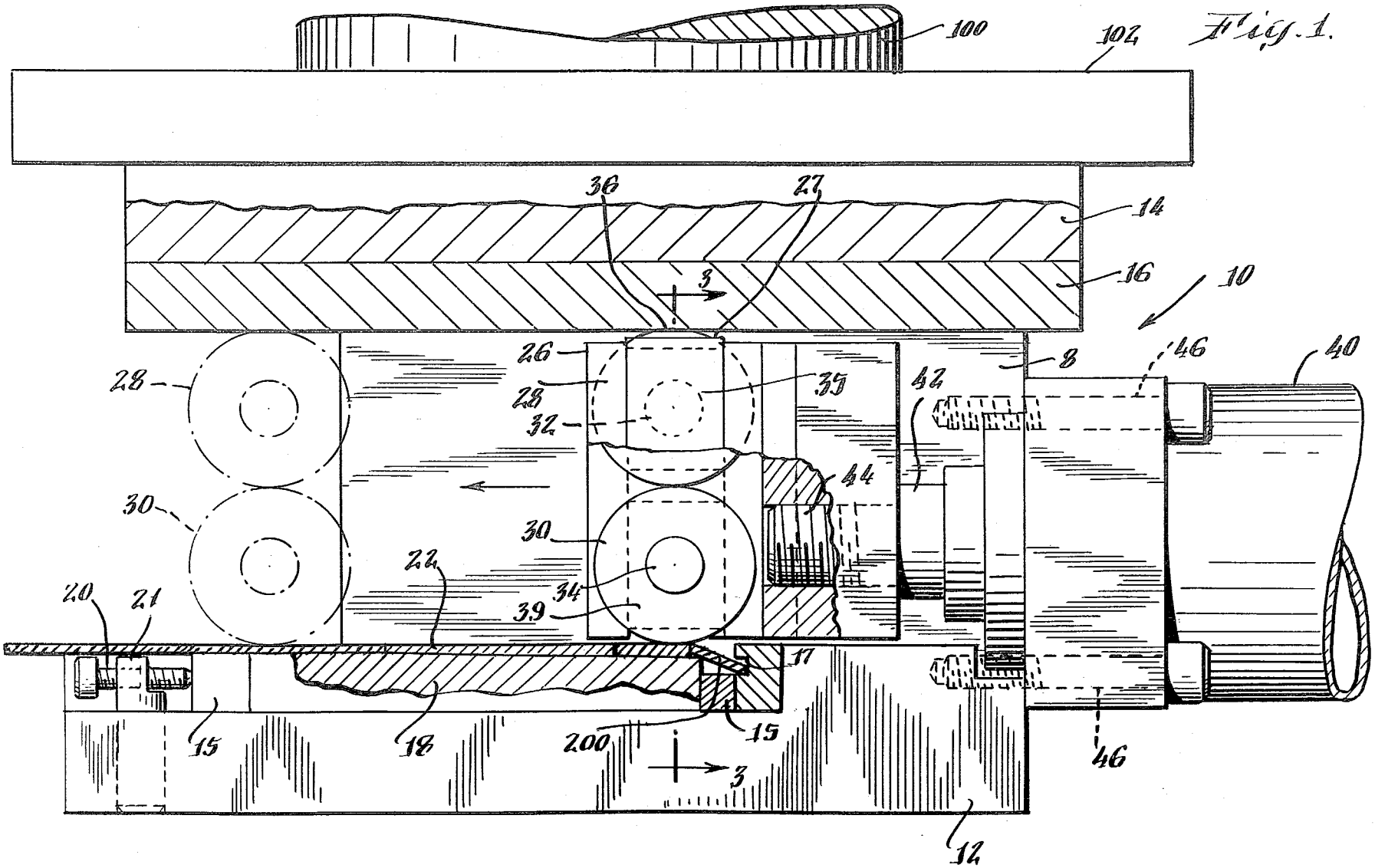
FIG. 1 is a side elevation view of an embodiment of this invention.
Figures 2, 4, 5, 6, 7:
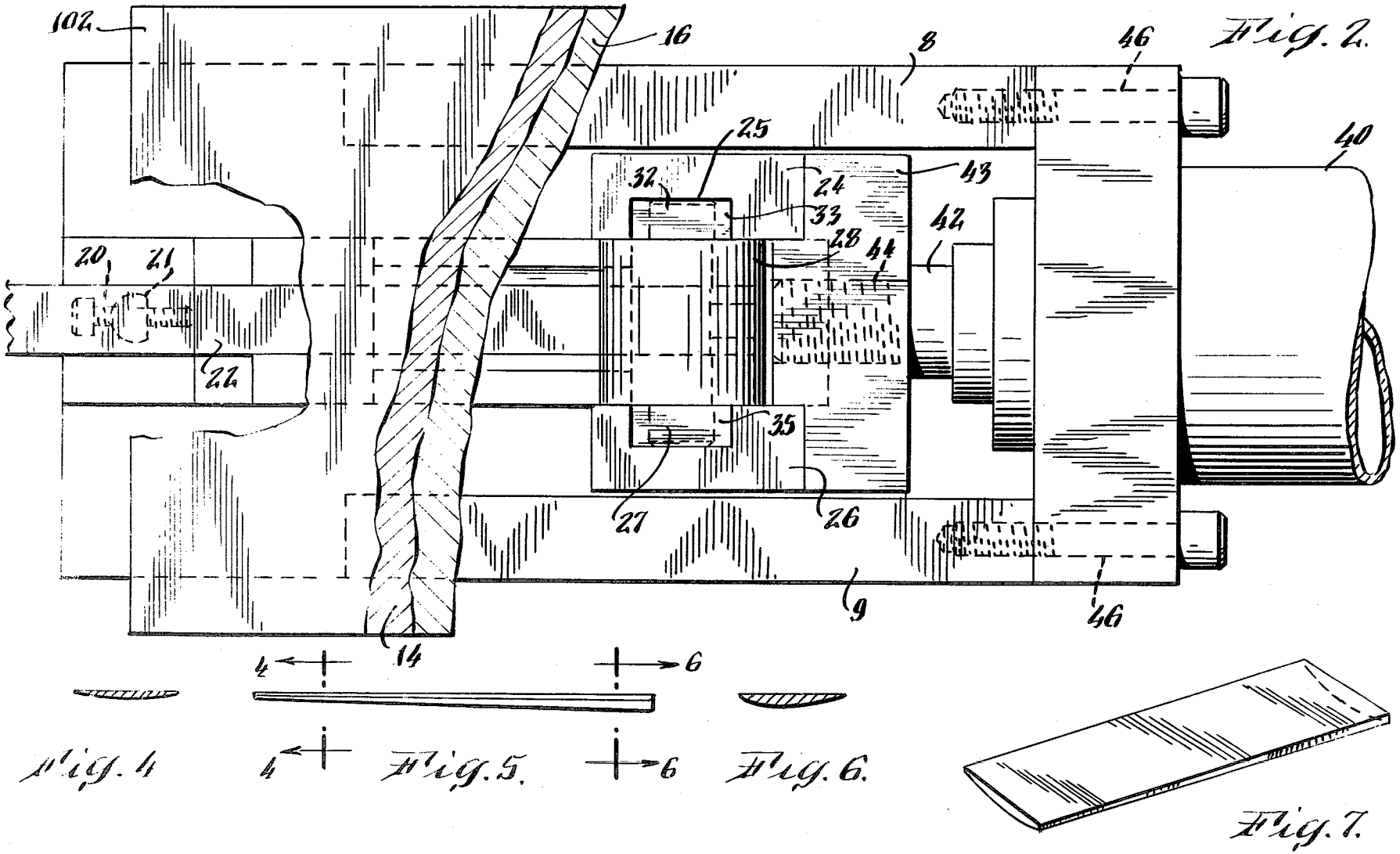
FIG. 2 is a plan view of the embodiment of this invention shown in FIG. 1.
FIG. 4 is a cross-section of a work piece made using embodiments of this invention through line 4—4 as shown in FIG. 5.
FIG. 5 is a side cross-section of a work piece made using embodiments of this invention.
FIG. 6 is a cross-section of a work piece made using embodiments of this invention through line 6—6 as shown in FIG. 5.
FIG. 7 is a perspective view of a work piece made using embodiments of this invention.

Referring first to FIG. 1, there is depicted a press roll machine 10 embodying the present invention. It includes a bed block 12, and a top block 14 having a hardened insert 16 laminated thereto for purposes of presenting a wear-resistant surface to the top roll 28 hereinafter described. Optionally, the top block 14 itself may be hard surfaced, rather than including the hardened insert 16. It is to be understood that the top block and hardened insert shown in FIG. 1 constitute convenient additions to the platen 102 of the vertical hydraulic assembly 100, since they provide easy changes to accomodate various roll and/or work piece dimensional variations. Optionally, however, the top block and the insert 16 may also be omitted and the platen 102 used alone. Positioned in a recess in the bed block 12 is a forming die 18, having a recess 22 therein which is substantially of the dimensions and shape of the piece which it is desired to be formed in the apparatus. The forming die 18 is retained in its desired position in the bed block 12 by means of spacers 15, and the operation of a set screw 20 acting in cooperation with a threaded mounting post 21. Positioned between the hardened insert 16 on the underside of the top block 14 and the upper surface of the plane described by the top surfaces of the base block 12 and the forming die 18, are a top roll 28 and a bottom roll 30, which are rotatably affixed to roll carriers 24, 26 by means respectively of axles 32, 34. The rolls 28, 30 contact each other, while roll 28 also contacts the bottom surface of the hardened insert 16 at point 36, and while roll 30 also contacts the top surface of the bed block 12 at point 38 and the forming die 18 depending where along its path of travel as hereinafter described it is positioned. As may be seen clearly in FIG. 2, the roll carriers 24, 26 are affixed to a roll carrier block 43 into which is screwed the threaded end 44 of piston rod 42 that is an integral part, with hydraulic cylinder 40, of a horizontal hydraulic ram assembly of known per se design. This ram assembly is bolted to the bed block 12 and the stop blocks 8, 9 by means of bolts 46. It will also be clear from both FIGS. 1 and 2, as well as from FIG. 3, that stop blocks 8, 9 are positioned on either side of the roll carriers 24, 26, and between the hardened insert 16 of top block 14 and bed block 12. The purpose of the stop blocks 8, 10 is to keep the bottom surface of the insert 16 rigidly spaced apart from the top surface of the bed block 12, so that as the rolls 28, 30 are thrust along therebetween through operation of the horizontal hydraulic ram assembly as hereinafter described, while the top block 14 and the bed block 12 are biased toward each other through operation of the platen 102 of vertical hydraulic ram 100, the rolls 28, 30 will not become flattened. The pressure of the vertical hydraulic assembly 100 and therefore of the platen 102 in a downward direction is regulated in sequentially increasing steps so that the material to be shaped in the die may be formed only to the extent desired in each pass of the rolls. This feature is particularly important with "aerospace" materials of the type referred to above (i.e., hard, durable alloys, as contrasted with comparatively soft and ductile materials such as copper, brass, bronze, aluminum, of the like), since characteristically they are not susceptible to being formed in a single pass. By this means, the amount of the downward-acting resistance of the vertical hydraulic ram platen to upward deflection induced by the lower roll interacting with the work piece may be adjusted and controlled in sequentially increasing steps with a high degree of accuracy.

Thus, in the first among a series of such passes, the pressure of downwardly-acting vertical hydraulic assembly may be so regulated that during one or more of the first passes, because of reduced pressure and the consequent yielding upward of the ram platen 102 in response to the inter-facial pressure between the bottom roll and the work piece in excess of the ram pressure, a gap will be caused to be produced above the stop blocks 8, 9, as lower roll 30 bears downward on the upper surface of the work piece as the roll traverses it. With each pass of the rolls, the pressure on the vertical hydraulic ram is sequentially increased so that sequential reductions and forming steps occur, until the final step is reached when the lower roll 30 traverses the top of the forming die 18, thereby causing the work piece to be formed to the final desired shape and dimension within predictable, reproduceable, acceptable limits of tolerance. At this final stage, by means of the stop blocks 8, 9, in effect, exactly the same vertical space is available between the bottom of the insert 16 and the top of the bed block 12 as the collective diameters of the two rolls together. Throughout the entire process, as the bottom roll 30 traverses the piece to be formed in the forming die 22, a high vertical downward bias may be imparted by the vertical hydraulic ram 100 to prevent the rolls 28, 30 from yielding upward in response to encountering the mass of the forming stock from which the forming piece is to be made. At the same time, downward pressure on the rolls is not exerted except by way of a counteracting response to such upward yielding of the rolls to the extent it actually occurs. In this connection, it should be noted that as shown particularly in FIGS. 1 and 2, the roll axles 32, 34 each have their ends positioned in "floating" carrier blocks 33, 35, 37, 39 which are vertically moveable by virtue of being positioned in vertically oriented slots 25, 27 in roll carriers 24, 26 respectively. By this means, the rolls 28, 30 are rendered easily removeable and capable of moving upward and downward without thereby putting stresses on the axles 32, 34. This permits the rolls to accomodate to vertical deflection induced by impingement upon the work piece, while at the same time causing the top block 14 and the base block 12 to become the primary load-bearers of the force moments resulting from such deflections. It should also be noted that the vertical hydraulic ram assembly acts as a safety release mechanism, since it provides a pre-determined amount of downward bias which, if exceeded by too much pressure at the roll-work piece interface, will cause the vertical hydraulic ram platen 102, and the top block 14 and/or the insert 16 if they are being used, to move upward to accomodate the excess pressure. This avoids exceeding the pressure tolerance of the various components, thus avoiding damage to or destruction of them.

From the foregoing, the operation of apparatus embodying this invention may be understood. With the horizontal hydraulic ram piston rod 42 in the fully retracted position (i.e., farthest to the right as shown in FIG. 1), a strip of metal 200 to be used as the work piece is positioned above the forming surface 22 of the forming die 18. With stop blocks 24, 26 in position, the vertical hydraulic ram is pressurized to the (lowest) desired pressure level for the first forming pass, causing the platen 102-top block 14-hardened insert 16 assembly to be lowered into contact with the tops of the stop blocks.

The piston rod 42 of the horizontal hydraulic ram apparatus 40 is then actuated causing the roll carriers 24, 26 to move away from the horizontal hydraulic ram apparatus (i.e., to the left as shown in FIG. 1). In this connection, it should be noted that it is desirable for the center of the hydraulic ram piston rod 42 to be only slightly above the axis of the lower roll axle 34 as shown in FIG. 1, as this has the effect of imparting the thrust on the roll assembly approximately at the center of the horizontal load distribution point. This reduces the tendency of the rolls in the roll assembly to cock out of vertical alignment as the lower roll traverses the work piece, since almost all of the resistance to the roll set tranversing is at the point of contact between the bottom roll and the work piece atop the die.

As the roll assembly moves in response to thrust imparted on it by the horizontal hydraulic ram, the lower roll 30 comes into contact with the work piece and begins to form it in the forming surface 22 which has been configured in the top surface of the forming die 18. As the roll assembly moves as described, the roller bearing-like arrangement of the rolls, with the two rolls in line contact with each other and with the top roll in line contact with the hardened insert 16 on the top block 14 at point 36, and with the bottom roll 30 in line contact with the top of the bed block 12 at point 38, the forming die 18 and the work piece, offers minimal friction resistance to the thrust moments of force. The result is that substantially the only work necessary to form the desired piece is that utilized in the reshaping of the mass of metal itself, without substantial heat, friction, or other non-beneficial energy losses. However, during the first pass, only a limited amount of reduction of the work piece occurs because the pressure of the vertical hydraulic ram assembly is at a low setting (e.g., 50–60 tons) which permits its platen 102 to yield upward in response to the lower roll coming into contact with the top surface of the work piece and both rolls therefore moving upward as their carrier blocks 33, 35, 37 39 move upward in slots 25, 27. In effect, therefore, the vertical downward pressure exerted by the bottom roll 30 on the work piece will be a direct function of the pressure setting of the vertical hydraulic ram assembly. When multiple passes are being utilized, the process is repeated one or more times with the pressure on the vertical hydraulic ram assembly being increased in each successive step. As each such additional pass occurs, the vertical hydraulic press platen will be lowered in correspondingly successive steps as the progressive pressure increases produce more working of the work piece with corresponding thickness reductions of it. For example, a typical working sequence to produce a 1"×4" fin from Hastalloy might include 4 successive pressure settings for the vertical hydraulic ram of 50 tons, 75 tons, 100 tons and 125 tons respectively, to achieve thickness reductions of about 80%, 30%, 15%, and 5% respectively. The non-linearity between these two step sequences might be attributed to work hardening. This of course, like the base pressure themselves, will vary widely according to the material and sequences being used. In that connection, one or more intermediate anneals may be utilized to render the work piece more susceptible to reduction for a given press loading. Following formation of the desired piece, it may then be cut off by known per se means. After the final thrust cycle has been completed, the piston of the vertical thrust ram may be withdrawn and the formed piece removed from the forming die.

It should be noted that as shown in FIG. 1, it is desirable to include in the bed block 12 a slot 17 into which the end of the strip of stock 200 from which the desired piece is to be formed may be positioned before the forming cycle begins. It is advantageous to form the slot so that it tilts slightly upward at the receiving end so that it may be accessed easily, following which the stock may be bent down over the end of the bed block to a parallel attitude with respect to the bed block 12. The effect of this is to hold the strip against linear migration as the bottom roll 30 comes into contact with it and moves along it in the course of forming the piece.

Referring again to FIG. 3, it will be seen that the forming surface 22 of the forming die 18 advantageously may be configured in any of a wide variety of cross-sectional shapes. A typical shape that is used to make jet engine compresser stator blades is shown in perspective view in FIG. 7. This shape, as formed in embodiments of this invention, for example as described above, has a flat side and an airfoil shaped side and generally parallel edges. In a subsequent operation, the piece is further worked in order to obtain a desired final shape, for example, with the flat surface rendered concave, the curved surface having a shorter radius of curvature, and/or with the blade twisted to a desired extent. This illustration shows another optional feature which may be incorporated into such dies in the form of trimming edges 54, 56 which serve the purpose of defining the longitudinal edges of the formed piece while trimming off any excess material which overflow during the forming process. The trimmings so generated may then be allowed to fall into the waste basins 58, 60 for removal after the desired piece has been formed, thus providing a means to ensure that the waste will not interfere with subsequent forming sequences. FIGS. 8 through 12 illustrate the complexity and wide range of configurations that it is possible to achieve in the practice of the present invention. The particular die illustrated therein incorporates the edge trimming feature described above, but, again, it is to be understood that this is a desirable option in the practice of the present invention. The plan view shown in FIG. 8 illustrates that pieces may be formed which have longitudinal edges that are not parallel. As shown, they converge toward each other, but, within certain limits, the edges may be of any of a wide variety of shapes, including arcuate portions, and may even be uniformly, intermittently, or substantially diverging from each other. The latitude available for such variations is governed generally by the ability of the metal from the forming stock strip to flow forward with the roll set and to fill out the void area in the forming die, so that the finished product produced from the intermediate stage will be within desired parameters of dimensions and configurations. Obviously too great or too radical an increase in cross-sectional area, past the availability of migrating material to fill it, may produce unsatisfactory results. Thus, a complex shape as illustrated in FIGS. 8 through 10 may be easily and effectively produced, with any of a variety of linear cross-sections, such as the straight tapered one shown in FIG. 11, or the arcuate tapered one shown in FIG. 12.

Figure 13:
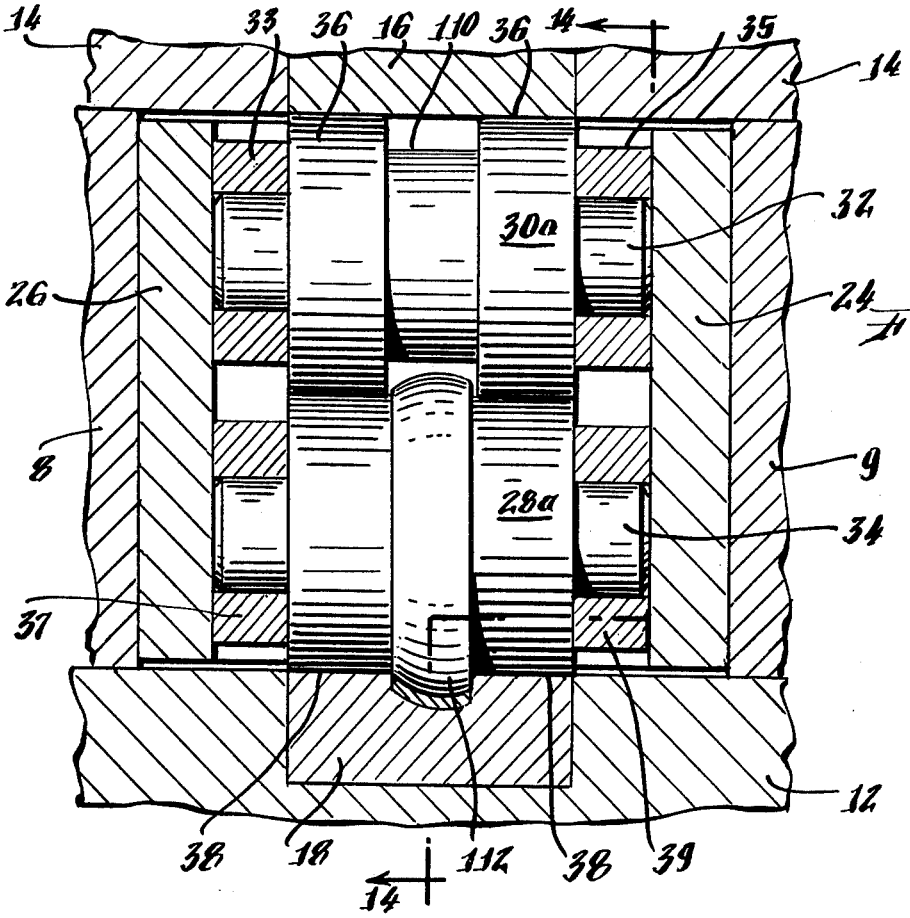
FIG. 13 is an end view of another embodiment of this invention.
Figure 14:
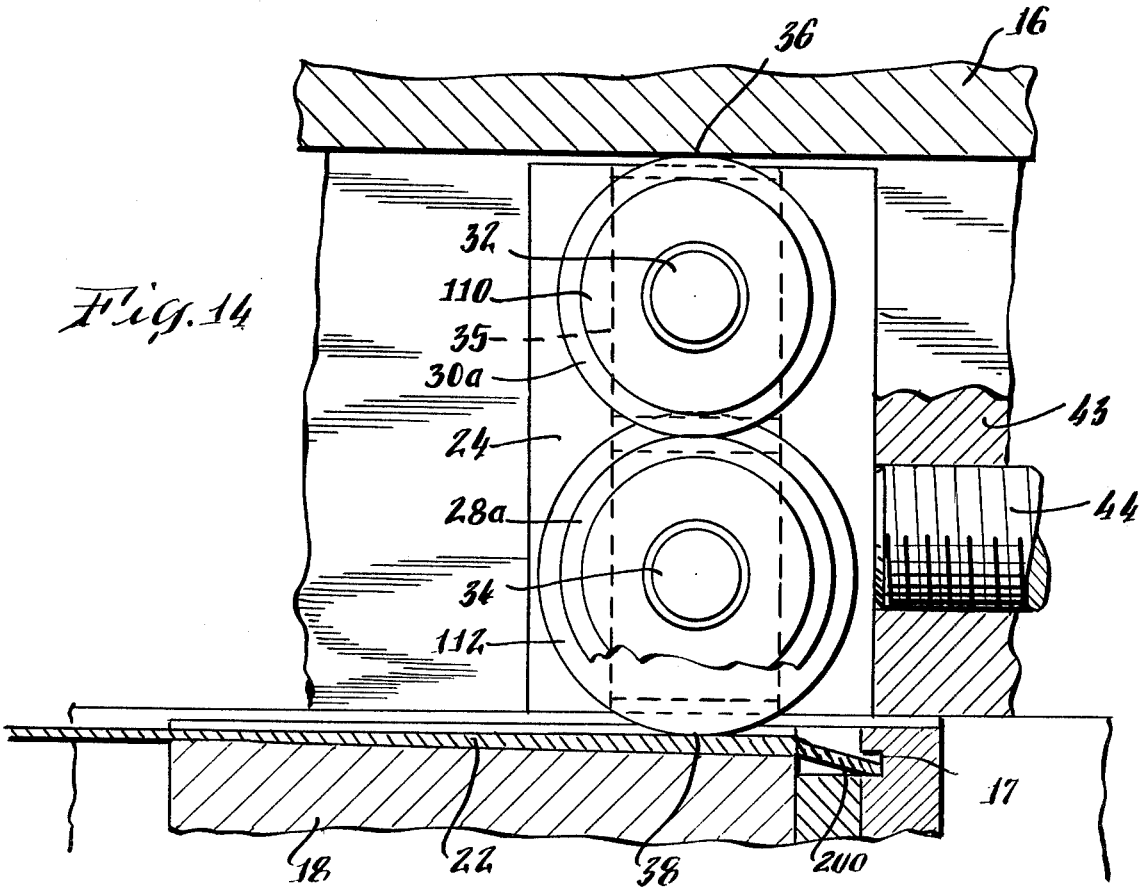
FIG. 14 is a side cross-section view of the embodiment of this invention shown in FIG. 13.
Figure 15:
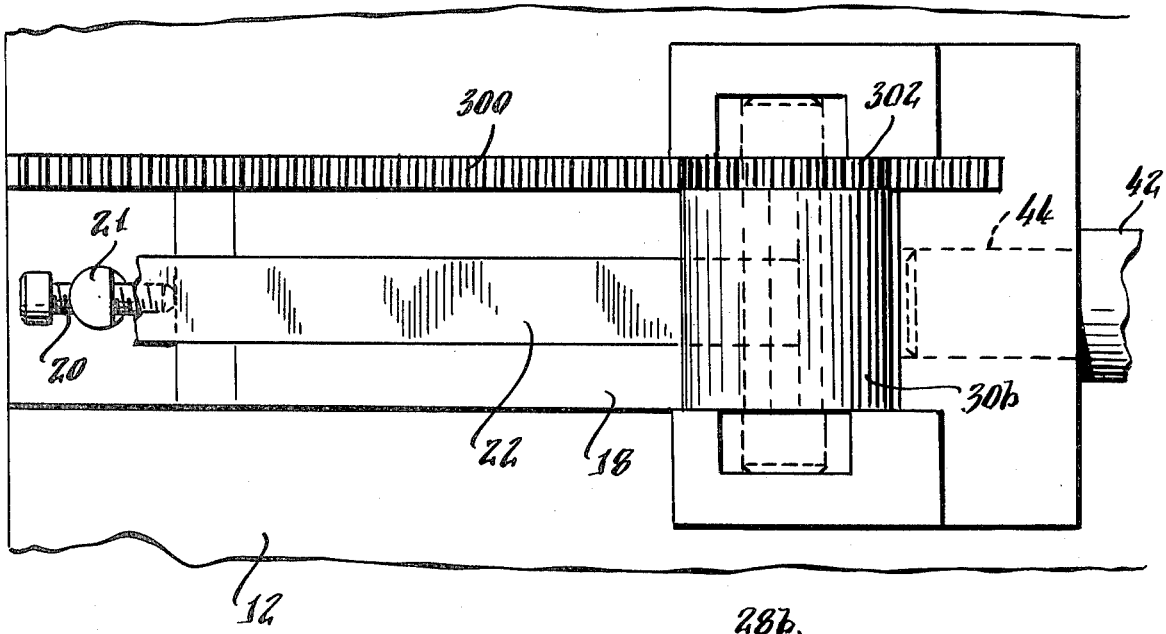
FIG. 15 is a plan-view of another embodiment of this invention.
Figure 16:
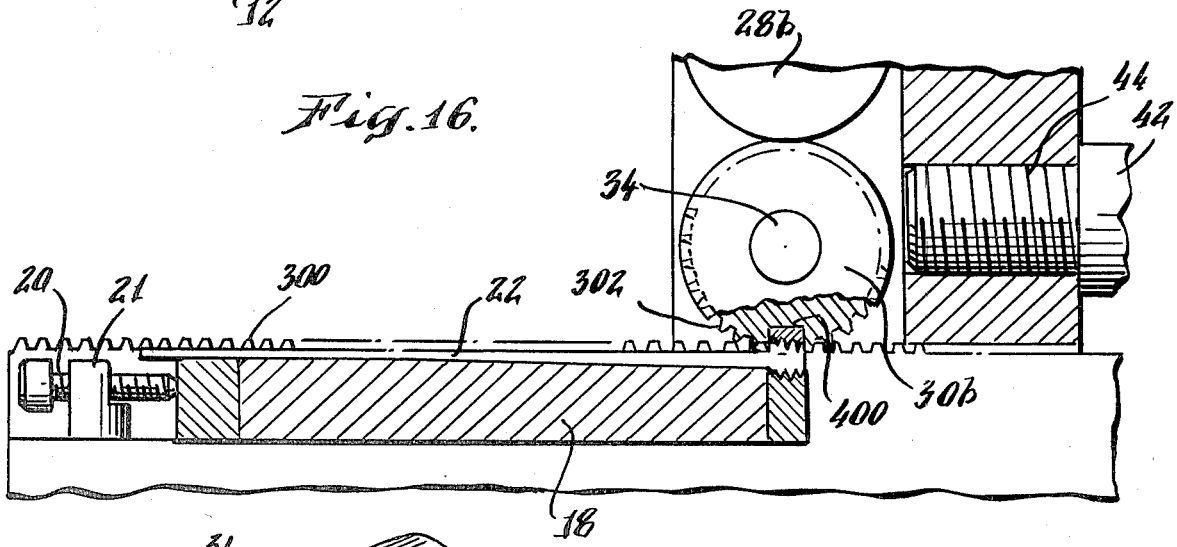
FIG. 16 is a side view of the embodiment of this invention shown in FIG. 15.

FIGS. 13 and 14 illustrate an embodiment of this invention that is useful to produce work pieces of even more complex cross-sectional configuration. The various components correspond to those previously illustrated and discussed, except that the rolls have been modified so as to render the lower roll, in effect, a die forming surface, with the top roll having been modified also, so as to accomodate the modification of the lower roll. Thus, there is included in the central region of the lower roll 28*a*, a raised portion 112 having a circumferential configuration which, in cross section, is substantially the same in shape and dimension as the desired top surface of the work piece that is being produced. In FIG. 13, that surface is shown to be a segment of an ellipse, but of course it could take any of a variety of shapes, whether arcuate, straight (at any of a variety of angles and/or directions of inclination), or irregular. The top roll 28*a* as shown has a circumferential recess 110 to accomodate the presence of the raised portion 112 of the lower roll 30*a*. In operation, the apparatus and its several components operate as in the embodiments previously described, but as shown in cross-section in FIG. 13 particularly, produce work pieces in which the upper surfaces, as well as the lower surfaces, are formed into desired configurations and dimensions as part of the same forming operation.

Figure 17:
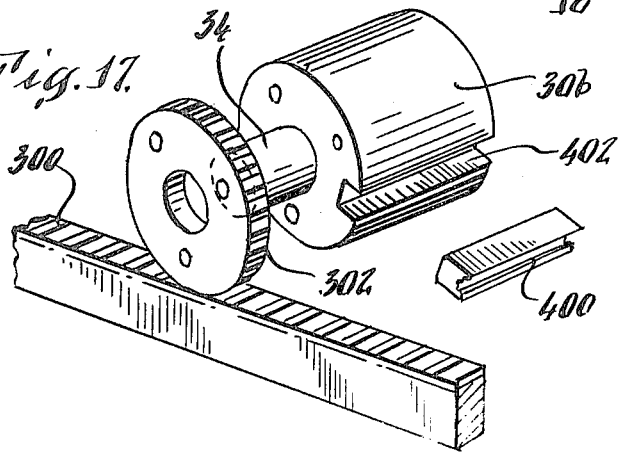
FIG. 17 is a perspective view of a roll device useful with the embodiment of this invention shown in FIG. 15.

FIGS. 15 through 18 illustrate embodiments of this invention useful in producing shaped objects which have a radical structural variation at one end from that of the rest of the structure. By this means, for example, it is possible to produce elongated objects having such things as a head, threads, or other structural features, including bolts, threaded inserts (as at the end of an otherwise blade-like piece), strips with ratchet or gear-like surfaces along all or part of their length, headed nail-like structures, base members such as T-shaped square, rectangular, or dove-tail blocks, or the like. Such desired features may desirably be positioned at either or both sides of the piece, at either or both ends, and/or along all or part of its length. As shown in plan view in FIG. 15 and in side view in FIG. 16, the several operative components of such apparatus correspond substantially to those previously illustrated and described with respect to other embodiments of this invention except that the lower wheel 30*b*, in addition to having a forming die 400 positioned in a die receptacle slot 402 in the face thereof as shown in FIG. 17, has a registration mechanism consisting of a pinion 302 integral with the roll 30*b*, acting cooperatively with the associated rack 300. By this means, correct positioning of the roll forming die 400 with respect to the work piece and the forming die 22 is assured as the mechanism operates with the roll moving backward and/or forward with respect to the die surface 22. In the event the forming die positioned in the face of the lower roll protrudes above the surface of the roll, it is desirable to provide a correspondingly shaped depression in the surface of the upper roll to accommodate it as the rolls turn and the protuberance moves into the region of the nip formed by the rolls. In that case, it is desirable to provide a gear on the upper roll in such position and of such configuration and size as to intermesh with the pinion on the lower roll, so as to ensure proper registration of the rolls with respect to each other with the proper alignment of the top roll depression to the bottom roll protuberance, so that the former will always provide a receptacle for the latter. It is also within the contemplation of this invention that the roll die insert may extend all the way across the face of the roll as shown in FIG. 17, or may extend less than the entire roll width.

Figure 18:
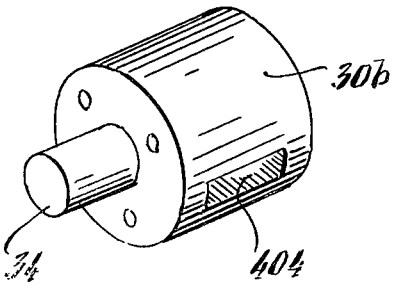
FIG. 18 is a perspective view of another roll device useful with the embodiment of this invention shown in FIG. 15.

FIG. 18 illustrates another embodiment of this invention, wherein the forming surface in the lower roll 30*b* consists of a depression 404 useful, for example to form one half of a "T" cross-section top on the work piece if the depression is rectangular in configuration, or of a bolt bead if it is polyangular, or a round head if it is semi-circular.

From the foregoing it will be apparent that this invention may be utilized to produce a wide variety of objects in addition to those specifically illustrated and discussed. Thus, it is to be understood that the embodiments that have been shown and described are by way of illustration and not of limitation, and that a wide variety of embodiments may be made without departing from the spirit or scope of this invention.

I claim:

1. Apparatus for forming objects from strips of metal comprising a base block having a flat, horizontally oriented, planar, upper surface that is adapted to receive a forming die, a top block assembly that includes a lower member having a flat, horizontally oriented, planar lower surface that is oriented parallel to and above said upper surface of said base block and is moveable as to proximity with respect thereto, vertically oriented hydraulic press means moveably interconnected with said top block for imparting selected amounts of bias to said top block against it being impelled away from said base block, a roll assembly positioned between said lower surface of said top block and the upper surface of said bottom block comprising two contacting cylindrical rolls which are oriented with the axes of said rolls parallel to each other and to both said lower surface of said top block and said upper surface of said bottom block and which describe a fictitious plane perpendicular to said surfaces and which are supported by roll support means, said roll assembly means being free to move along a path perpendicular to said fictitious plane, horizontally oriented hydraulic motion means which acts upon said roll support means for causing said roll support means and said rolls to move along a path which is parallel to said surfaces and perpendicular to said fictitious plane, and stop block means positioned between said top block assembly and said base block for positionally limiting the proximity of said surfaces with respect to each other to a distance equal to the collective diameters of said two rolls, whereby a strip of metal forming stock may be positioned above a forming die positioned in said base block and an object of desired configuration and dimensions produced by causing one or more reciprocations of said roll assembly through operation of said motion means while said roll assembly is biased against deflection upward in excess of pre-determined amounts along the path described by said fictitious plane in response to coming into contact with said strip as said assembly reciprocates by means of biasing pressure applied to said top block by means of said press means that is applied thereto in selected amounts which may be increased successively with sequential reciprocations of said roll assembly until reciprocation occurs with said top block positioned in the closest proximity to said base block that is permitted by said stop blocks.

2. The apparatus described in claim 1 wherein the circumferential surface of said bottom roll includes a die forming contour.

3. The apparatus described in claim 2 wherein said die orming contour projects above said surface of said lower roll and wherein the circumferential surface of said top roll includes accomodation means to accomodate said die forming contour.

4. The apparatus described in claim 3 wherein said die forming contour is a circumferential protuberance and wherein said accomodation means in said top roll is a groove.

5. The apparatus described in either of claims 1 or 2 including registration means for regulating the position of said die forming contour with respect to a die positioned in said base block.

6. The apparatus described in claim 3 including registration means for regulating the position of said die forming contour with respect to a die positioned in said base block and with respect to said accomodation means in said top roll.

7. Apparatus for forming objects comprising a base means which has a flat planar surface that includes forming die means, a roll-backer member having a flat planar surface which is moveably positionable in parallel, spaced-apart relationship to said planar surface of said base means, positioning means positioned between said base means and said roll-backer member for limiting to a desired minimum distance the proximity of said roll-backer member with respect to said base means, pressure means moveably interconnected with said roll backer means for imparting bias to said roll-backer member against said roll-backer member being impelled away from said base means, said pressure means being characterized by the fact that the amount of biasing pressure imparted by it to said roll-backer member may be fixed at pre-determined maximum levels which will not be substantially exceeded upon said roll-backer member being impelled away from said base member counter-directionally to said biasing pressure, roll means comprising two rolls positioned with their outer surfaces in linear contact with each other, with the roll closest said roll-backer member in linear contact with its said planar surface and with the roll closest said base member means in linear contact with its said planar surface, with the lines of said contacts describing a flat fictitious plane which is substantially perpendicular to said planar surfaces of said roll-backer member and said base means, roll support means supporting said rolls, which support means is moveable along a path which is substantially perpendicular to said fictitious plane, and roll motion means which acts upon said roll support means for moving said roll support means in a direction which is substantially perpendicular to said ficitious plane.

8. The apparatus described in claim 7 wherein said planar surface of said roll-backer member is hard-surfaced.

9. The apparatus described in claim 8 wherein said forming die means comprises means for receiving and holding a forming die.

10. The apparatus described in claim 7 wherein said positioning means limits the minimum distance between said roll-backer means and said base means to substantially the sum of the diameter of said two rolls.

11. The apparatus described in claim 10 wherein said pressure means comprises a hydraulic press.

12. The apparatus described in claim 10 wherein said roll motion means comprises a hydraulic press.

13. The apparatus described in claim 11 wherein said roll motion means comprises a hydraulic press.

14. The apparatus described in any of claims 7 through 13 wherein the surface of said lower roll is adapted to include a die-forming surface.

15. The apparatus described in any of claims 7 through 13 wherein the surface of said lower roll is adapted to include a die-forming surface by including a circumferential protuberance and wherein said top roll includes a circumferential depression in the surface thereof to accomodate said protuberance.

16. The apparatus described in any of claims 7 through 13 wherein the surface of said lower roll is adapted to include a die-forming surface by including a depression in the face thereof.

17. The apparatus described in any of claims 7 through 13 wherein the surface of said lower roll is adapted to include a die-forming surface by including a depression in the face thereof that is adapted to receive a forming die therein.

18. The apparatus described in any of claims 7 through 13 wherein the surface of said lower roll is adapted to include a die-forming surface by including a depression in the face thereof that is adapted to receive a forming die therein and wherein the face of said top roll includes a recess to accomodate a forming die positioned in said depression that extends outside the circumference of said lower roll.

19. The apparatus described in any of claims 7 through 13 wherein the surface of said lower roll is adapted to include a die-forming surface by including a depression in the face thereof and includes registration means for positioning said depression at desired angular positions along the path of travel of said roll.

20. The apparatus described in claim 17 wherein the surface of said lower roll is adapted to include a die-forming surface by including a depression in the face thereof and includes registration means for positioning said depression at desired angular positions along the path of travel of said roll.

21. The apparatus described in claim 18 wherein the surface of said lower roll is adapted to include a die-forming surface by including a depression in the face thereof and includes registration means for positioning said depression at desired angular positions along the path of travel of said roll.

22. The apparatus described in claim 18 wherein the surface of said lower roll is adapted to include a die-forming surface by including a depression in the face thereof and includes registration means for positioning said depression at desired angular positions along the path of travel of said roll with respect both to said forming die means in said base means and with respect to circumferential position on said top roll.

* * * * *